US010464223B2

(12) United States Patent
Scalise

(10) Patent No.: US 10,464,223 B2
(45) Date of Patent: Nov. 5, 2019

(54) KNIFE AND METHOD

(71) Applicant: Dominick Scalise, Baden, PA (US)

(72) Inventor: Dominick Scalise, Baden, PA (US)

( * ) Notice: Subject to any disclaimer, the term of this patent is extended or adjusted under 35 U.S.C. 154(b) by 73 days.

(21) Appl. No.: 15/458,486

(22) Filed: Mar. 14, 2017

(65) Prior Publication Data

US 2017/0266822 A1 Sep. 21, 2017

Related U.S. Application Data

(60) Provisional application No. 62/308,807, filed on Mar. 15, 2016.

(51) Int. Cl.
*B26B 5/00* (2006.01)
*B26B 29/02* (2006.01)

(52) U.S. Cl.
CPC ..... *B26B 5/003* (2013.01); *B26B 29/025* (2013.01)

(58) Field of Classification Search
CPC ..... B26B 5/003; B26B 29/025
USPC ..... 30/329, 30, 331, 337, 338, 339, 342
See application file for complete search history.

(56) References Cited

U.S. PATENT DOCUMENTS 515,045 A * 2/1894 Von Bültzingslöwen ..... B23B 31/103 279/77
1,940,855 A * 12/1933 Friedman ..... A61B 17/3213 279/24
2,316,985 A * 4/1943 Niedermayer ..... A61B 17/3213 30/335
2,501,940 A * 3/1950 Hibbard ..... A47J 45/071 16/425
2,546,387 A * 3/1951 Coffing ..... F16B 7/042 16/427
2,605,545 A * 8/1952 Weems ..... B26B 5/00 220/829
3,187,431 A * 6/1965 Mattes ..... A61B 17/3213 30/339
3,262,205 A * 7/1966 Arden ..... A61B 17/3213 30/338
3,609,864 A * 10/1971 Bassett ..... A61B 17/3213 30/261

(Continued)

*Primary Examiner* — Laura M Lee
(74) *Attorney, Agent, or Firm* — Ansel M. Schwartz

(57) ABSTRACT

A knife for holding a blade having a bottom with a hole and a cutting tip which extends from the bottom includes a body having a rest zone for the bottom of the blade to be disposed in the body, and a mouth at a front end of the body which receives the bottom of the blade. The mouth guides the bottom of the blade to the rest zone. The body includes a recess in communication with the rest zone. The knife includes a lock disposed in the recess for securely holding the blade. The lock has a base which is fixedly attached inside the body. When in a locked state, the lock end is disposed in the hole in the bottom of the blade which holds the blade in place and the blade is unable to move from the rest zone. When in an unlocked state, the lock end separate and apart from the hole in the bottom of the blade so the blade can be moved from the rest zone. The lock having a move disposed between the lock end and the base. When a force is applied to the move, the move moves the lock end between the unlocked state and the locked state. Alternatively, there is a jaw with the lock end for the blade. A method for positioning a blade relative to a knife.

2 Claims, 17 Drawing Sheets

(56) References Cited

U.S. PATENT DOCUMENTS 3,845,554 A * 11/1974 Joanis ..... B26B 5/00 30/125
4,196,515 A * 4/1980 Sugiyama ..... B26B 5/002 30/162
4,292,738 A * 10/1981 Osada ..... B26B 5/002 30/162
4,466,377 A * 8/1984 Kolb ..... B25G 3/18 16/422
6,928,738 B2 * 8/2005 Segrea ..... B26B 21/40 30/34.1
7,337,546 B2 * 3/2008 Cheng ..... B26B 1/04 30/156
8,181,352 B1 * 5/2012 Shackelford, Sr. ..... A61B 17/3213 30/162
8,191,267 B2 * 6/2012 Patel ..... B25G 3/18 30/339
8,201,336 B2 * 6/2012 De ..... B26B 5/001 30/162
8,567,069 B2 * 10/2013 Robinson ..... B26B 5/00 30/155
8,572,850 B2 * 11/2013 Wu ..... B26B 5/005 30/125
9,113,946 B2 * 8/2015 Hajgato ..... A61B 17/3213
9,586,329 B2 * 3/2017 Schuft ..... A22B 5/168
2005/0055833 A1 * 3/2005 Scarla ..... B26B 1/02 30/156
2005/0274024 A1 * 12/2005 Jinliang ..... B26B 1/042 30/153
2009/0300920 A1 * 12/2009 Jiang ..... B26B 1/00 30/152
2010/0024221 A1 * 2/2010 Hernandez ..... B26B 5/001 30/296.1
2013/0255087 A1 * 10/2013 Wang ..... B26B 1/042 30/156
2014/0366387 A1 * 12/2014 Schuft ..... A22B 5/168 30/293

* cited by examiner 20
2
3
1
50
40
40

62
58
40

1
40
50

2
3
12
54

1
1

1

FIG 2E
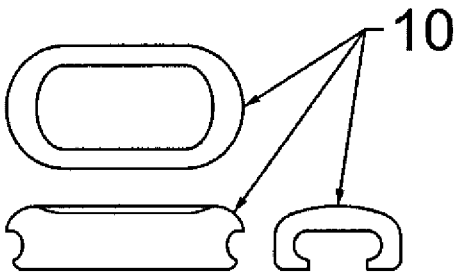
FIG 2F
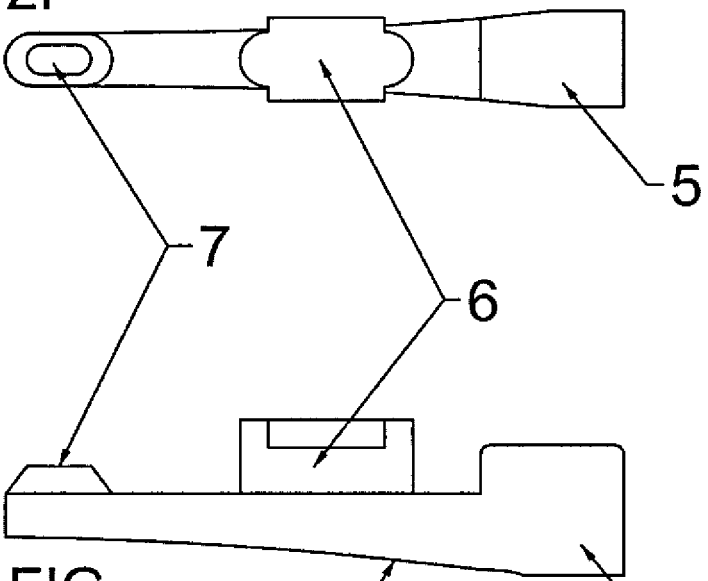
FIG 2G 2
3
40
64
11
40
40
54
40

1
1

1

9
9
9

9
9
34
64

22
2
3
7
1
4

22
2
3
7
1

22
3
26
28

50
8
8
8
68

8

6
7
4
1
5
8
64
50

20
2
3
7
5
8
1
68

5
64

22
20
2
3
7
40
12
4
10
5
6
8
1
50
40
58

22
20
2
3
7
12
4
10
5
6
8
1
50
40
58

22
3
26
40
5
8
1
50
40
58

8

22
20
7
3
6
4
9
34
40
8
1
50
40
58

22
20
7
3
6
40
4
9
34
8
1
50
40
58

22
26
40
8
50
40

2
3
6
7
4
38
1

20

38
1
38

13

8
64
42
68
13
40
20

KNIFE AND METHOD

CROSS-REFERENCE TO RELATED APPLICATIONS

This is a non-provisional of U.S. provisional patent application Ser. No. 62/308,807 filed on Mar. 15, 2016, incorporated by reference herein.

FIELD OF THE INVENTION

The present invention is related to a knife having an easily removable blade, where the blade can be locked into place in the knife or unlocked and removed from the knife with the use of a switch. (As used herein, references to the "present invention" or "invention" relate to exemplary embodiments and not necessarily to every embodiment encompassed by the appended claims.) More specifically, the present invention is related to a knife having an easily removable blade, where the blade can be locked into place and the knife or unlocked and removed from the knife with the use of a switch and with the use of a lock having a lock end which engages with a hole in the bottom of the blade that is positioned in a rest zone in a body of the knife.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

Precision knives, such as an X-ACTO™, Swann Morton Scalpels, disposable craft knives or utility knives, may be used by a hobbyist, seamstress, signage maker, filmmakers or other users that require a precision or intricate and exacting cut for long cut times. While these types of knives are common, they have limitations. X-ACTO™ type knives have a collet style system. This system is known for the collet to loosen when the user is working the knife, thus they need to stop to re-tighten the collet. Swann Morton style scalpels do not come apart. However, replacing a blade takes effort. Disposable craft knives do not replace blades and utility knives are bulky and have excessive blade movement for a precision cut. Moreover, none of these craft knives have an opening at the front of the knife to help guide the craft blade end into the receiving end for faster blade changes.

BRIEF SUMMARY OF THE INVENTION

The present invention includes embodiments which provide a craft blade which, when inserted in a body utilizes a hold and lock and unlock and release type system. This system is not a screw type system like X-ACTO™. Embodiments will not unscrew or unravel while working the knife, because the blade is in a set and locked position. Moreover, the system will unlock to release for blade replacement, whereas the Morton style scalpel knife holds the blade firmly but has no blade release. Moreover, it is not so easy to replace a blade on the Morton style scalpel knife. The slit openings of other craft knives that receive the blade base are small and narrow. This makes it hard to locate and position the blade base into their knives. Embodiments provide an opening shaped like a mouth to help guide the butt of the craft blade into a rest zone of the body. The open mouth shape at the front end of the body helps to assists to locate the rest zone for faster blade changes. Some utility knives have a quick change button to change blades. However, there can be a slight struggle when replacing the blade. Embodiments provide a smooth transition when replacing a blade. Moreover, these knives have excessive blade movement because they are not meant for precision cutting. Embodiments are designed to significantly minimize or even stop the movement of the craft blade. Utility knives can also be bulky, so they are not meant for lengthy cut times. However, the present invention is ergonomic in design and created for long cut times. Disposable craft knives can be comfortable; however, disposable knives are just that, disposable. The present invention allows for straightforward blade replacement. Embodiments provide a cap that safely stores the knife when not in use. Moreover, the cap can be affixed to the opposite end of a pen. This serves two functions, one to keep the cap from being lost and two, stop the craft knife from rolling off-angle surfaces. Lastly, embodiments have a place to store extra blades.

The present invention pertains to a knife for holding a blade having a bottom with a hole and a cutting tip which extends from the bottom. The knife comprises a body having a rest zone for the bottom of the blade to be disposed in the body, and a mouth at a front end of the body which receives the bottom of the blade. The mouth guides the bottom of the blade to the rest zone. The body includes a recess in communication with the rest zone. The knife comprises a lock disposed in the recess for securely holding the blade. The lock has a base which is attached inside the body. When in a locked state, the lock end is disposed in the hole in the bottom of the blade which holds the blade in place and the blade is unable to move from the rest zone. When in an unlocked state, the lock end separate and apart from the hole in the bottom of the blade so the blade can be moved from the rest zone. The lock having a move disposed between the lock end and the base. (The move is the point of contact and can be designed to be adjusted at any part of the lock.) When a force is applied to the move, the move moves the lock end between the unlocked state and the locked state.

The present invention pertains to a knife for holding a blade having a bottom with a hole and a cutting tip which extends from the bottom. The knife comprises a body having a jaw with a rest zone for the bottom of the blade to be disposed in the body. The body includes a mouth at a front end of the body through which the blade extends. The jaw able to open and close. When the jaw is closed, the body is in a locked state and when the jaw is open, the body is in an unlocked state. The knife comprises a lock end extending from the rest zone. When the lock end is in a locked state, the lock end disposed in the hole in the bottom of the blade which holds the blade in place and the blade is unable to move from the rest zone. When the lock end is in an unlocked state, the blade can be moved from the rest zone. The knife comprises a switch having a housing which fits over the body. The housing able to move over the body. When the housing is moved toward the mouth of the body, the housing contacts the jaw and closes over the jaw, maintaining the body and the lock in the locked state. When the housing is moved back from the mouth, the jaw able to open and the lock in the body are in the unlocked state.

The present invention pertains to a method for positioning a blade relative to a knife. The method comprises the steps of inserting a bottom end of a blade through a mouth at a front end of a body until the bottom of the blade is disposed on a rest zone in the body. The mouth guiding the bottom of the blade to the rest zone. There is the step of applying a force to a move of a lock disposed in a recess of the body in communication with the rest zone so the move moves a lock end of the lock between an unlocked state and a locked state. The lock locks for securely holding the blade. The lock having a base which is fixedly attached inside the body. When in the locked state, the lock end disposed in a hole in the bottom of the blade which holds the blade in place and the blade is unable to move from the rest zone. When in the unlocked state, the lock end separate and apart from the hole in the bottom of the blade so the blade can be moved from the rest zone. The move disposed between the lock end and the base.

BRIEF DESCRIPTION OF THE SEVERAL VIEWS OF THE DRAWING

In the accompanying drawings, the preferred embodiment of the invention and preferred methods of practicing the invention are illustrated in which:

FIGS. 2A-2G show a second embodiment of the present invention.

DETAILED DESCRIPTION OF THE INVENTION

Figure 1A:
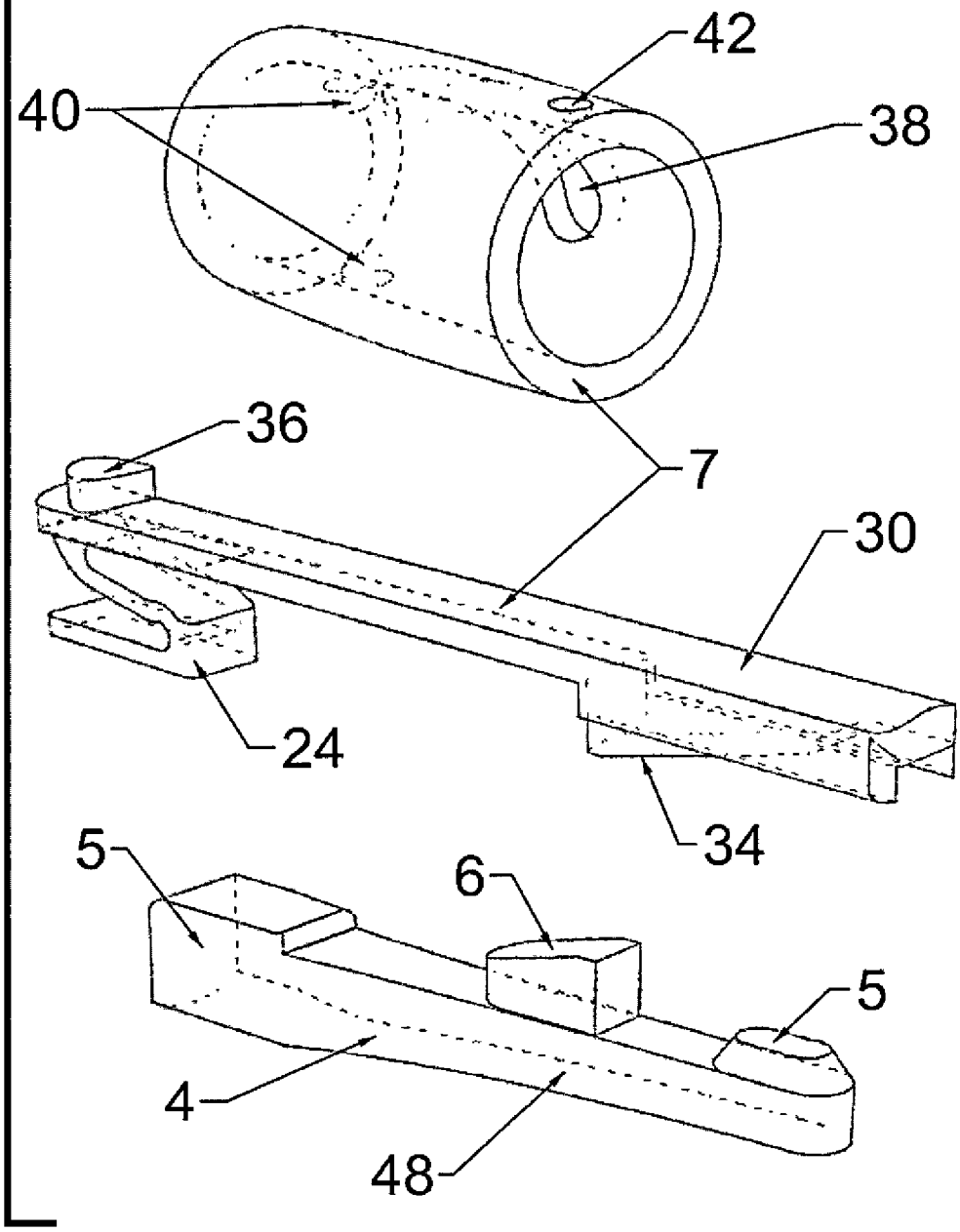
FIGS. 1A-1E show a first embodiment of a knife of the present invention.
Figures 1B, 1C:
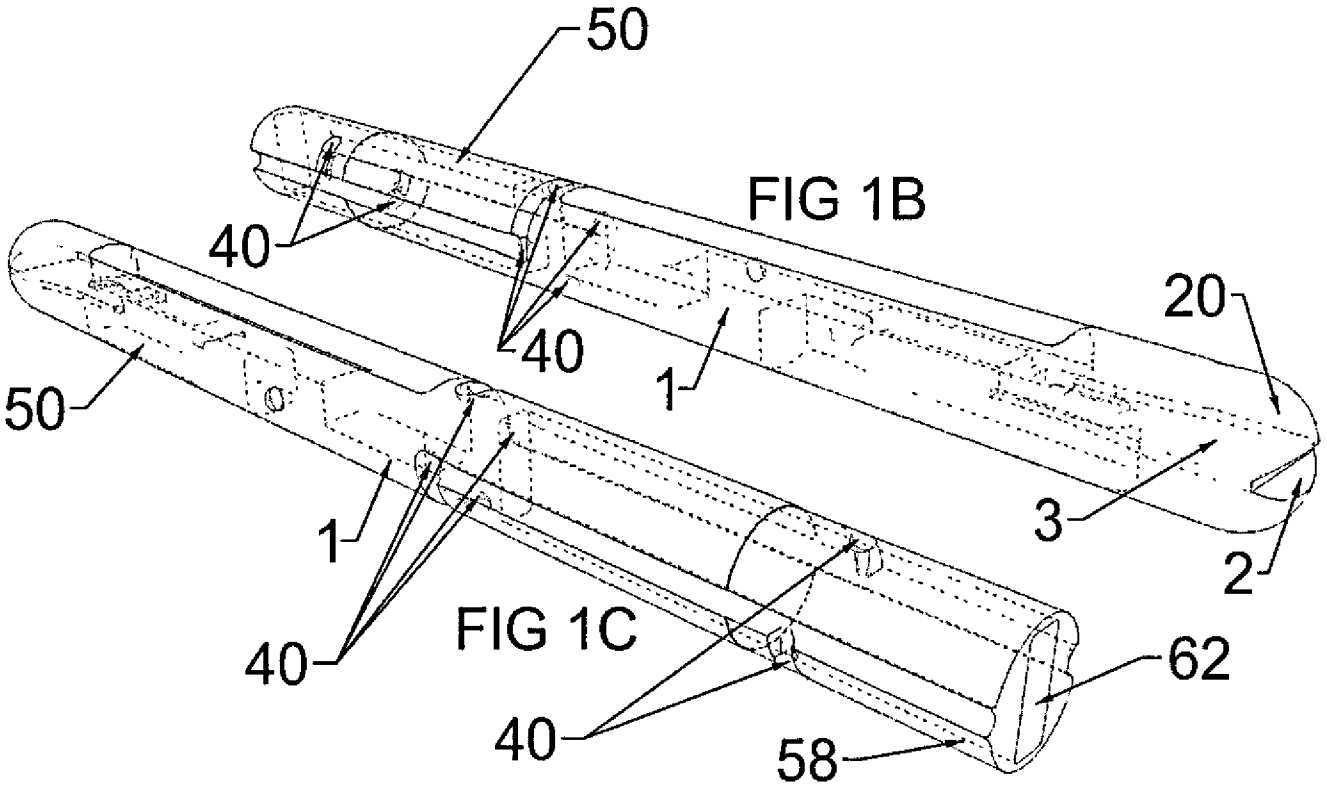
Figure 1D:
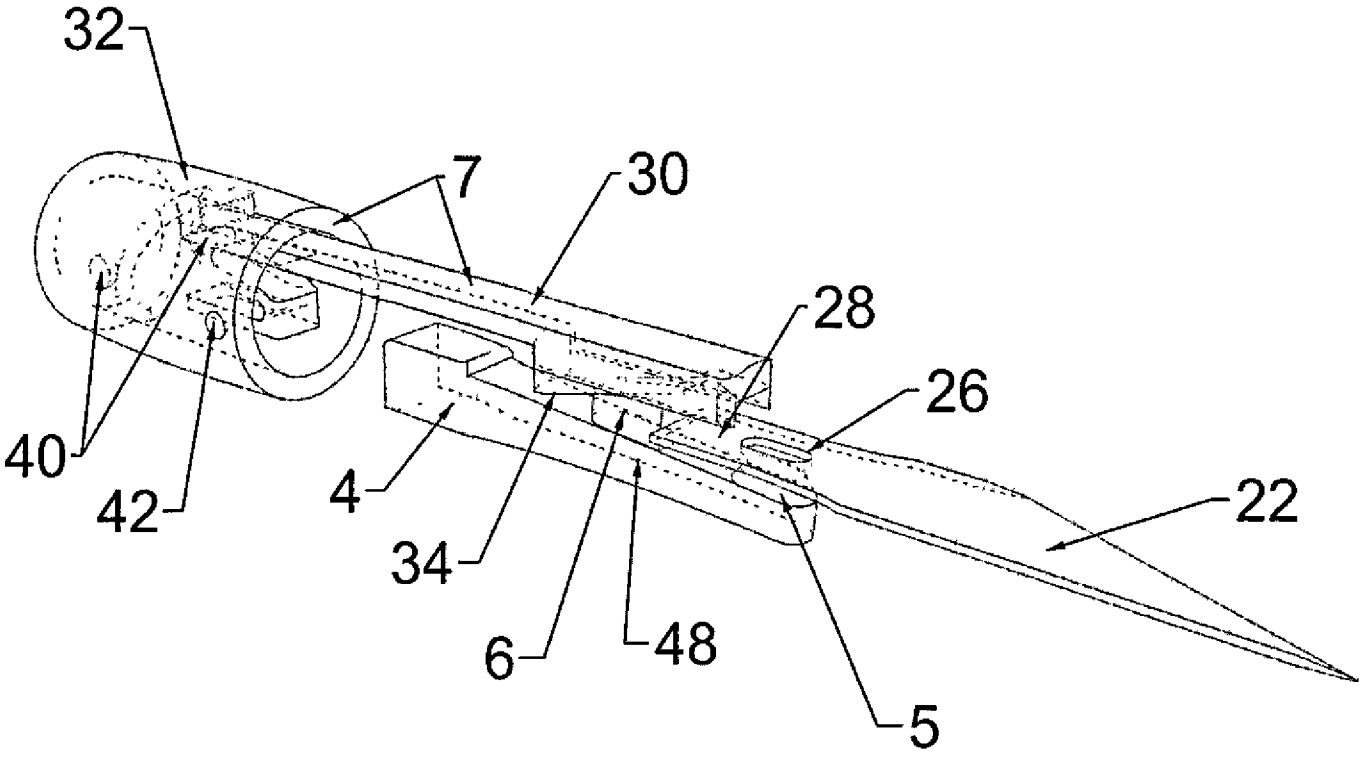
Figure 1E:
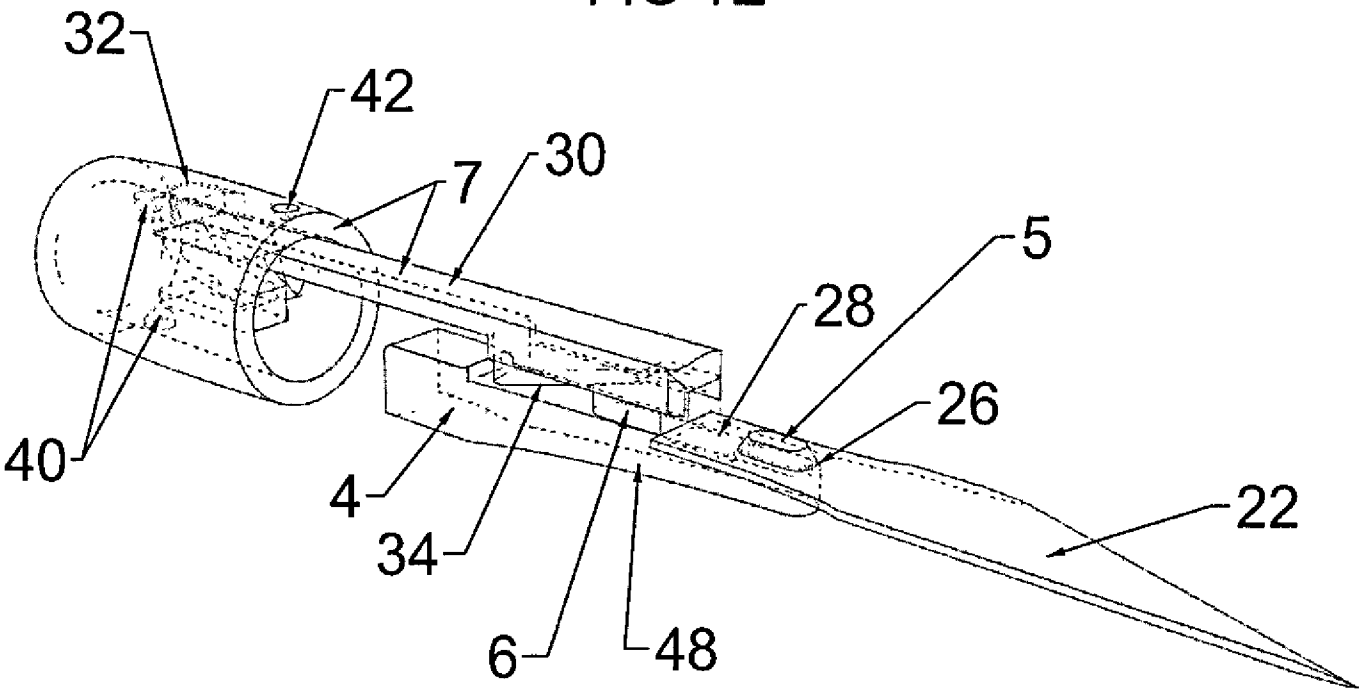

Referring now to the drawings wherein like reference numerals refer to similar or identical parts throughout the several views, and more specifically to FIGS. 1A-1E, 2A-2G thereof, there is shown a knife 50 for holding a blade 22 having a bottom 28 with a hole 26 and a cutting tip 60 which extends from the bottom 28. The knife 50 comprises a body 1 having a rest zone 3 for the bottom 28 of the blade 22 to be disposed in the body 1, and a mouth 2 at a front end 20 of the body 1 which receives the bottom 28 of the blade 22. The mouth 2 guides the bottom 28 of the blade 22 to the rest zone 3. The body 1 includes a recess 11 in communication with the rest zone 3. The knife 50 comprises a lock 4 disposed in the recess 11 for securely holding the blade 22. The lock 4 has a base 5 which is attached, preferably fixedly, inside the body 1. When in a locked state, the lock end 7 is disposed in the hole 26 in the bottom 28 of the blade 22 which holds the blade 22 in place and the blade 22 is unable to move from the rest zone 3. When in an unlocked state, the lock end 7 separate and apart from the hole 26 in the bottom 28 of the blade 22 so the blade 22 can be moved from the rest zone 3. The lock 4 having a move 6 disposed between the lock end 7 and the base 5. When a force is applied to the move 6, the move 6 moves the lock end 7 between the unlocked state and the locked state. The body 1 may have an opening 54 and may include a switch 9 in communication with the recess 11 through the opening 54 and engage with the lock 4 and movably attach to the body 1. The switch 9 contacts the move 6. When the switch 9 moves between an unlocked state and a locked state, the switch 9 contacts the move 6 and moves the move 6, causing the lock 4 to move between the unlocked state and the locked state or the locked state and the unlocked state. The switch 9 may rotate relative to the body 1 to cause the lock 4 to move between the locked state and the unlocked state or the unlocked state and the locked state.

Figures 5A, 5B, 5C:
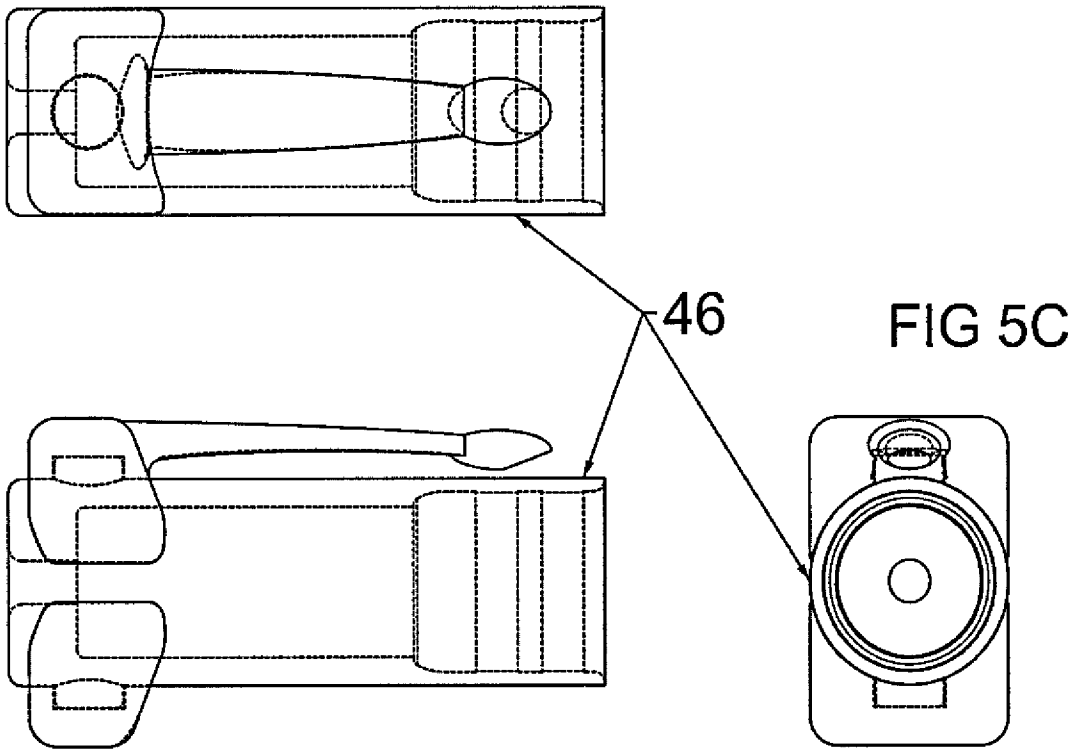
FIGS. 5A-5C show a cap.
Figure 6A:
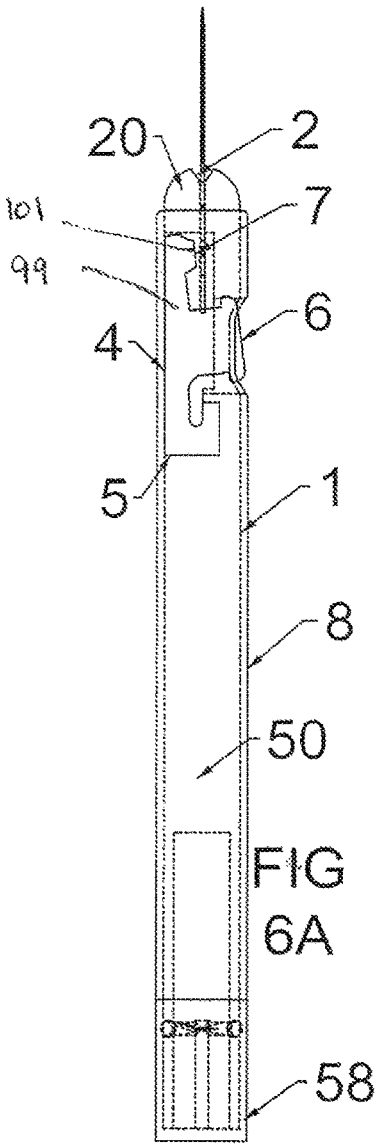
FIGS. 6A-6D show a sixth embodiment of the present invention.
Figure 6B:
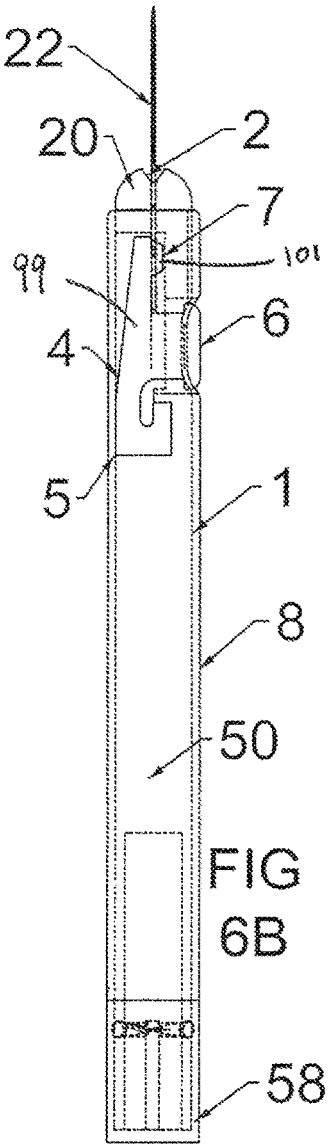
Figure 6C:
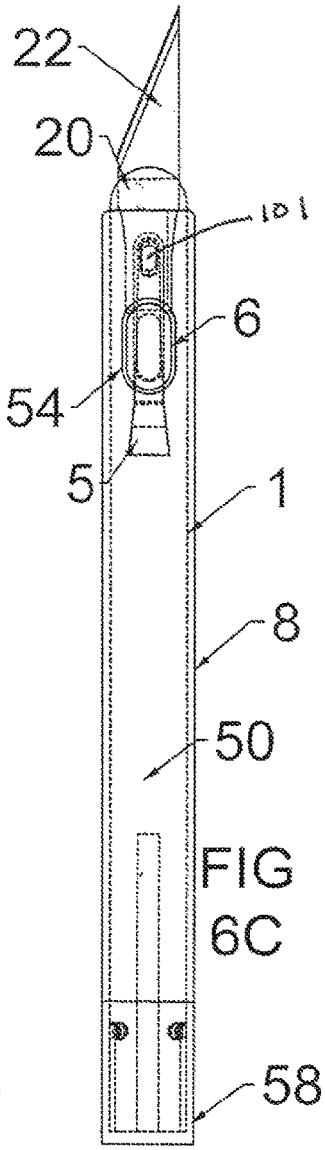
Figure 6D:
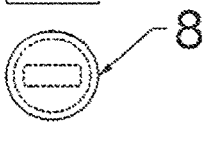
Figures 7A, 7B, 7C, 7D:
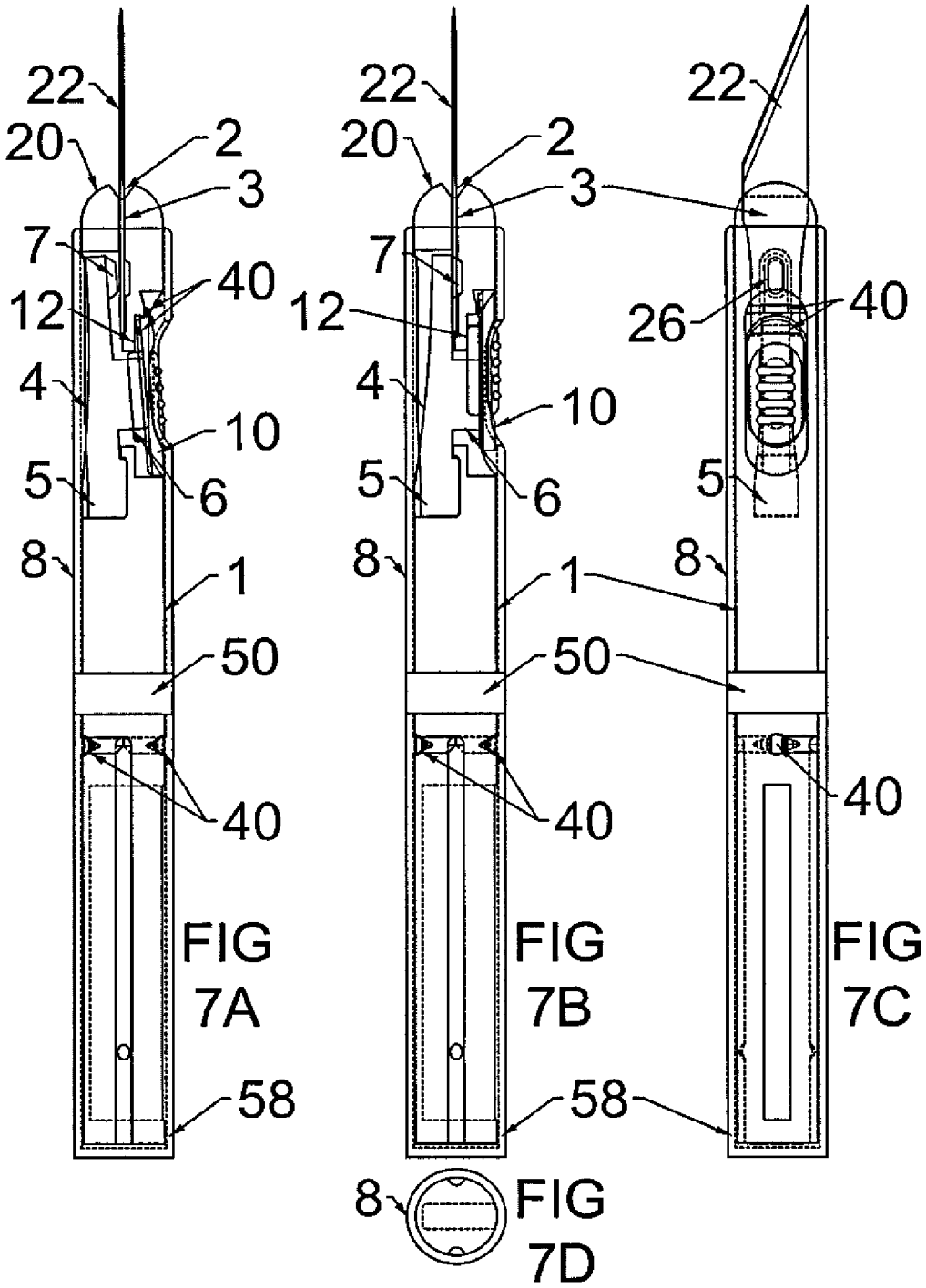
FIGS. 7A-7D show a seventh embodiment of the present invention.
Figures 8A, 8B, 8C:
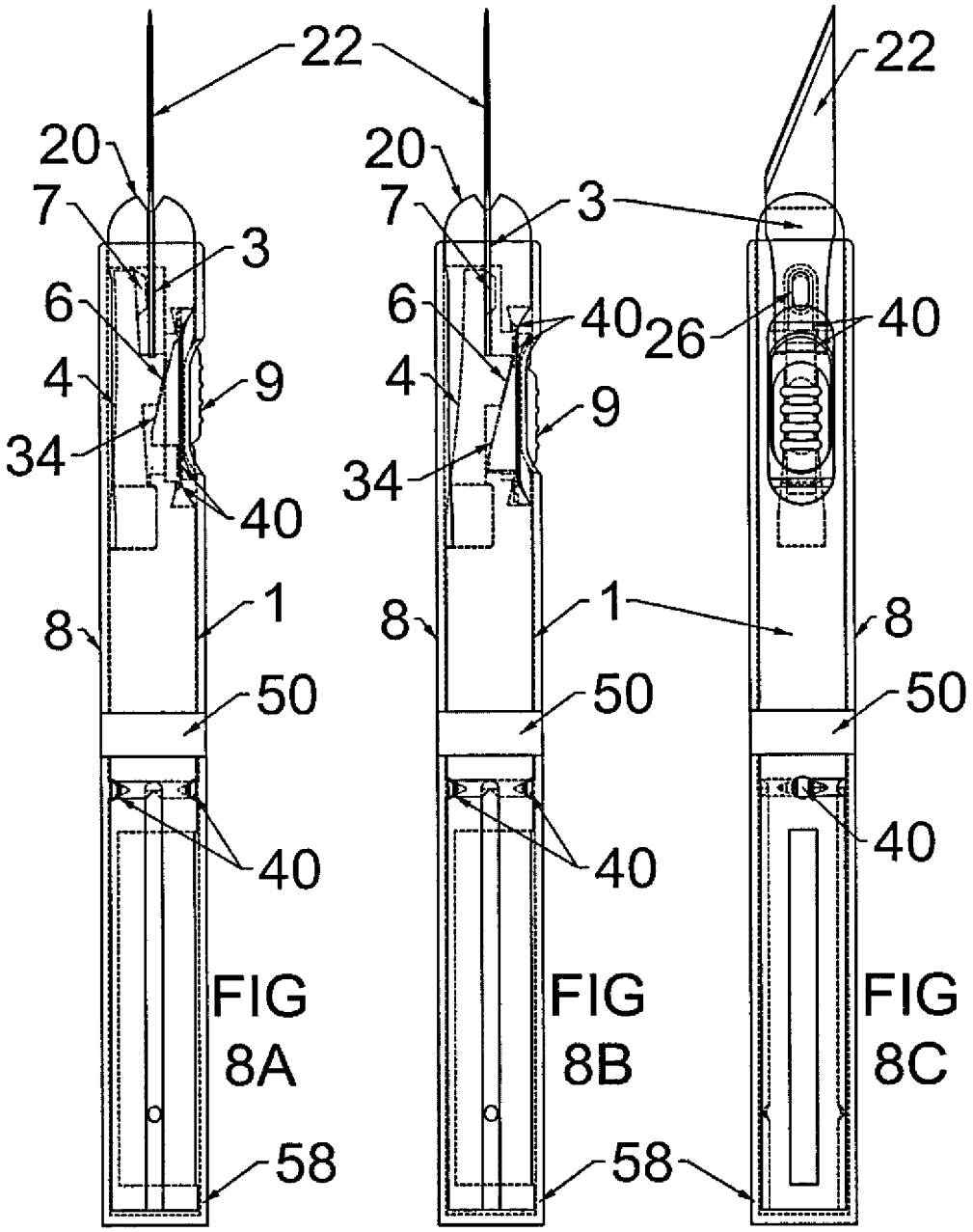
FIGS. 8A-8E show an eighth embodiment of the present invention.
Figures 8D, 8E:
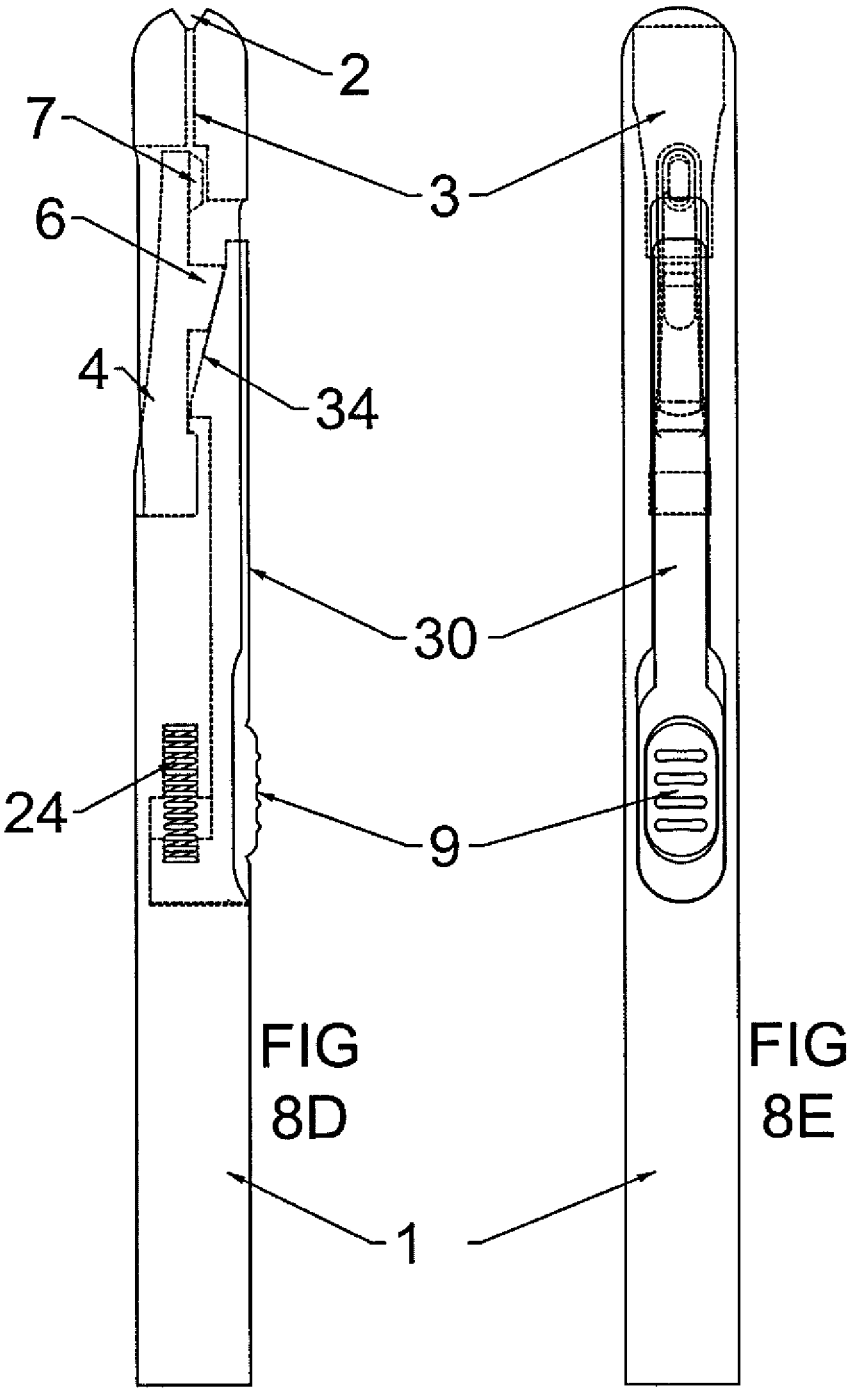
Figures 9A, 9B, 9C, 9D, 9E, 9F:
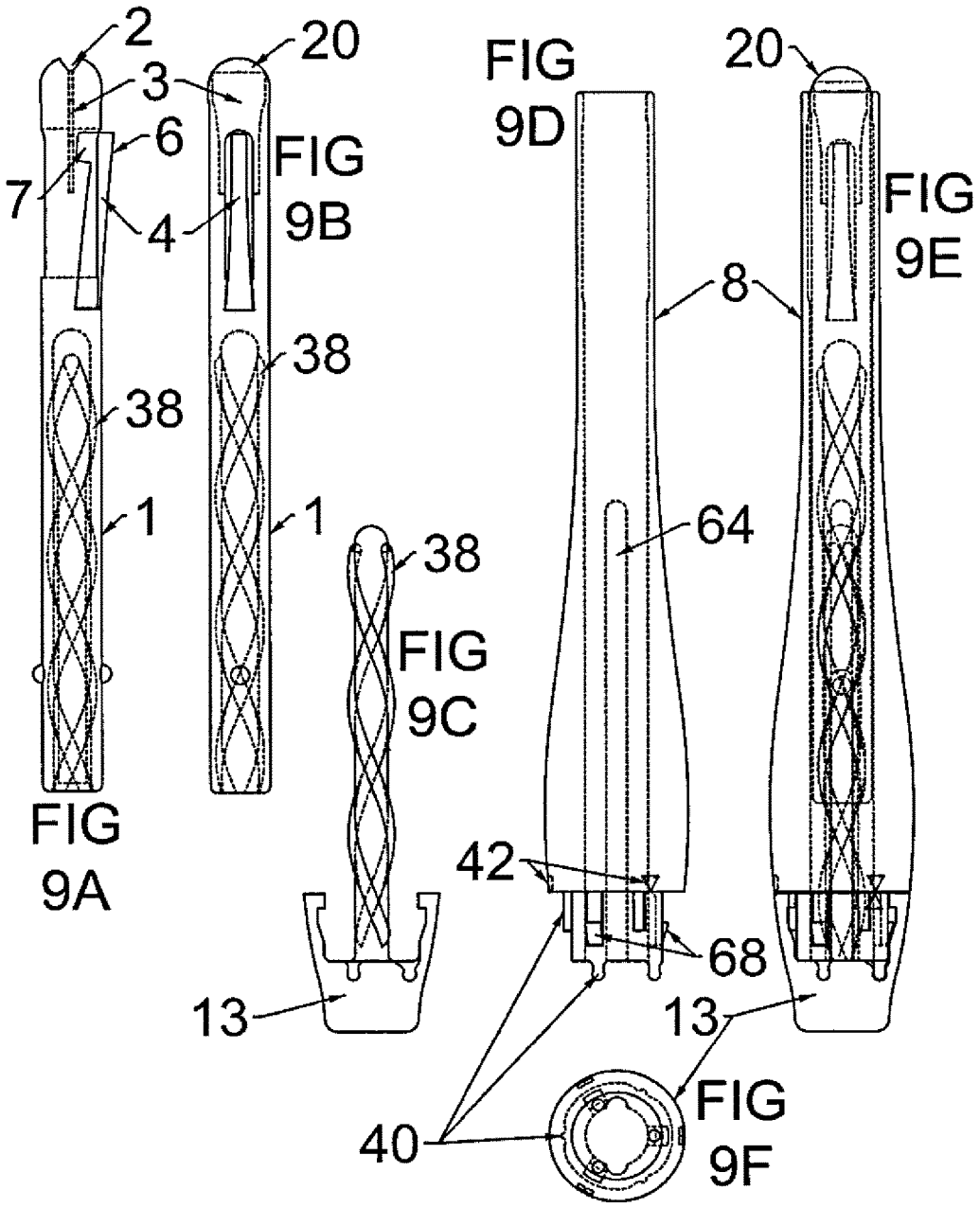
FIGS. 9A-9F show a ninth embodiment of the present invention.

The switch 9 may have a rotation 32 with a helix screw 38, and an arm 30 with a pin 36 and a deflector 34 disposed in the recess 11 adjacent the lock 4. The pin 36 is disposed in the helix screw 38. When the rotation 32 is rotated, the helix screw 38 moves the pin 36 which moves the deflector 34 to contact the move 6 of the lock 4 to move the lock end 7 and move the lock 4 between the locked state and the unlocked state or the unlocked state and the locked state. The rotation 32 disposed about the body 1 with the pin 36 extending from the arm 30 in the recess 11 into the helix screw 38. The rotation 32 may have a snap indicator 40 which indicates by sound or feel to a user whether the switch 9 is in the locked or unlocked state, and a switch indicator 42 which indicates whether the switch 9 is in the locked or unlocked state. The knife 50 may include a removable cap 46, as shown in FIGS. 5A-5C, which fits over the blade 22 and contacts the body 1, or which fits over the body's rear end 58. The body 1 may have a storage zone 62 disposed in the body's rear end 58 to store inside the body 1 an additional blade 22.

The body 1 may include a slip 64 adjacent the recess 11 and the switch 9 fits into the recess 11 and is able to move in the recess 11, as shown in FIGS. 2H-2P. The switch 9 has a deflector 34 which extends into the recess 11. When the switch 9 moves in the slip 64, the deflector 34 contacts the move 6 of the lock 4, moving the lock 4 between the locked state and the unlocked state.

Figures 4A, 4B, 4C:
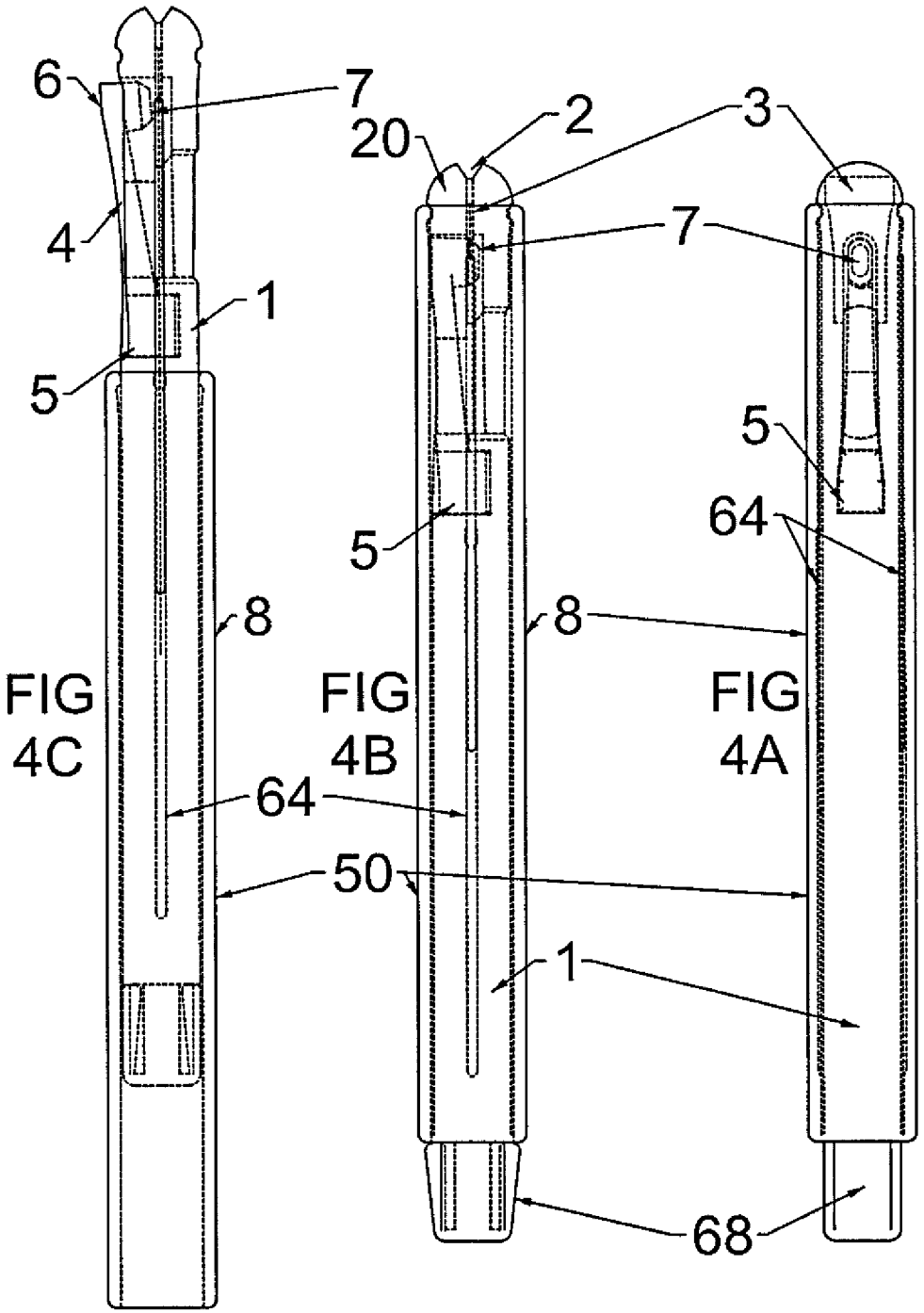
FIGS. 4A-4C show a fifth embodiment of the present invention.

The switch 9 may include a housing 8 which fits over the body 1 and has a deflector 34 which extends into the recess 11 through an opening 54 in the body 1, as shown in FIGS. 4A-4C. The housing 8 able to move over the body 1. When the housing 8 moves over the body 1, the deflector 34 contacts the move 6 of the lock 4, moving the lock 4 between the locked state and the unlocked state. The lock 4 may include a stem 48 that extends from the base 5 toward the rest zone 3 with a lock end 7 extending from the stem 48.

Figures 3A, 3B, 3C, 3D:
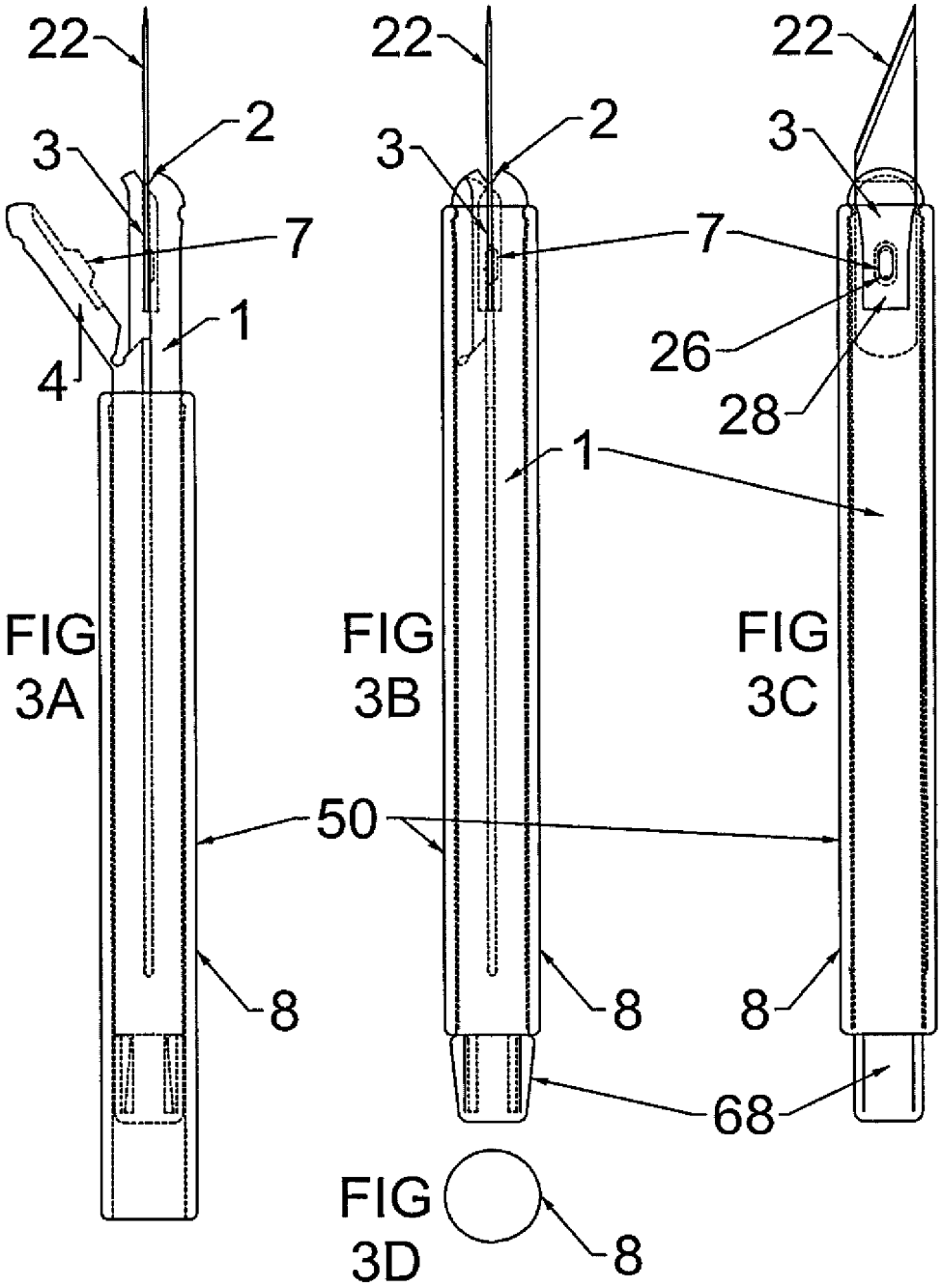
FIGS. 3A-3D show a fourth embodiment of the present invention.

The present invention pertains to a knife 50 for holding a blade 22 having a bottom 28 with a hole 26 and a cutting tip 60 which extends from the bottom 28. The knife 50 comprises a body 1 having a jaw 56 with a rest zone 3 for the bottom 28 of the blade 22 to be disposed in the body 1, as shown in FIGS. 3A-3C. The body 1 includes a mouth 2 at a front end 20 of the body 1 through which the blade 22 extends. The jaw 56 able to open and close. When the jaw 56 is closed, the body 1 is in a locked state and when the jaw 56 is open, the body 1 is in an unlocked state. The knife 50 comprises a lock end 7 extending from the rest zone 3. When the lock end 7 is in a locked state, the lock end 7 disposed in the hole 26 in the bottom 28 of the blade 22 which holds the blade 22 in place and the blade 22 is unable to move from the rest zone 3. When the lock end 7 is in an unlocked state, the blade 22 can be moved from the rest zone 3. The knife 50 comprises a switch 9 having a housing 8 which fits over the body 1. The housing 8 able to move over the body 1. When the housing 8 is moved toward the mouth 2 of the body 1, the housing 8 contacts the jaw 56 and closes over the jaw 56, maintaining the body 1 and the lock 4 in the locked state. When the housing 8 is moved back from the mouth 2, the jaw 56 able to open and the lock 4 in the body 1 are in the unlocked state.

The present invention pertains to a method for positioning a blade 22 relative to a knife 50 a knife. The method comprises the steps of inserting a bottom end of a blade 22 through a mouth 2 at a front end 20 of a body 1 until the bottom 28 of the blade 22 is disposed on a rest zone 3 in the body 1. The mouth 2 guiding the bottom 28 of the blade 22 to the rest zone 3. There is the step of applying a force to a move 6 of a lock 4 disposed in a recess 11 of the body 1 in communication with the rest zone 3 so the move 6 moves a lock end 7 of the lock 4 between an unlocked state and a locked state. The lock 4 for securely holding the blade 22. The lock 4 having a base 5 which is fixedly attached inside the body 1. The lock 4 may have a stem 48 that extends from the base 5 toward the rest zone 3 with the lock end 7 extending from the stem 48. When in the locked state, the lock end 7 disposed in a hole 26 in the bottom 28 of the blade 22 which holds the blade 22 in place and the blade 22 is unable to move from the rest zone 3. When in the unlocked state, the lock end 7 separate and apart from the hole 26 in the bottom 28 of the blade 22 so the blade 22 can be moved from the rest zone 3. The move 6 disposed between the lock end 7 and the base 5.

The body 1 may have an opening 54 and include a switch 9 in communication with the recess 11 through the opening 54 and engaged with the lock 4 and movably attached to the body 1. There may be the step of the switch 9 contacting the move 6, and including the step of moving the switch 9 between an unlocked state and a locked state so the switch 9 contacts the move 6 and moves the move 6, causing the lock 4 to move between the unlocked state and the locked state. The moving step may include the step of rotating the switch 9 relative to the body 1 to cause the lock 4 to move between the locked state and the unlocked state. The switch 9 may have a rotation 32 with a helix screw 38, and an arm 30 with a pin 36 and a deflector 34 disposed in the recess 11 adjacent the lock 4. The pin 36 may be disposed in the helix screw 38, and the rotating step may include the step of rotating the rotation 32 so the helix screw 38 moves the pin 36 which moves the deflector 34 to contact the move 6 of the lock 4 to move the lock end 7 and move the lock 4 between the locked state and the unlocked state. The rotation 32 may be disposed about the body 1 with the pin 36 extending from the arm 30 in the recess 11 into the helix screw 38.

The knife comprises a body, as described above for holding the blade, and a clamp disposed within the body or the recess of the body which engages with the blade, and securely holds the blade in the body so it cannot be removed when the clamp is in the locked state. Here the clamp, as one example, is the lock having the lock end which moves into the hole in the bottom of the blade when the blade is positioned inside the body, preferably in the rest zone. If desired, the switch can be used to move the clamp between the locked or unlocked state, as described herein.

In the operation of the invention, in a first embodiment, as shown in FIGS. 1A-1E, on the front end 20 of the body 1, is the mouth 2. This is where the blade 22 is guided into the knife 50 to assist for faster installation. Through the mouth 2 is the rest zone 3. This is where the blade 22 comes to a set position. Around the rest zone 3 resides the lock 4.

The lock 4 has three defining properties. The base 5, the move 6 and the lock end 7. All three properties are formed as one part. (However, the lock end 7 can be made of other materials.) The base 5 is the part of the lock 4 that is attached to the body 1. That means it is free on all sides but the fixed side. This allows it to work like a diving board or to be springy. However, the lock can be attached on multiple sides or corners.

Between the lock end 7 and the base 5 is the move 6. The move 6 is the part of the lock 4 that comes in contact with the switch 9. When the switch 9 proceeds forward and contacts the move 6, the lock spring force is deflected to relocate the lock end 7 out of the way for the blade 22 to be placed into or out of the rest zone 3. However, this can be reversed. When the switch 9 is drawn back away from the move 6, the spring force returns the lock 4 to its original position. It is in the release position that the lock end 7 penetrates the rest zone 3 to contact the blade 22 hole 26. (However, it could be reversed.)

On the free side of the lock 4 is the lock end 7. The lock end 7 is the part of the lock 4 that penetrates the rest zone 3 and comes in contact with the bottom 28 of the blade 22. The lock end 7 has a shape or protrusion and the shape can be hard or made of multiple materials that are hard and rubbery. The shape of hard or hard and rubbery materials, fits, fills or squeezes into the hole 26 of the bottom 28 of the blade 22 end configuration to hold it tight. The lock 4 in this configuration is moved to lock or unlock by a switch 9. In this version, the switch 9 is made of two parts, the arm 30 and the rotation 32.

The arm 30 has three defining properties. The deflector 34, the pin 36 and the spring 24. All three properties are formed as one part. On the front end 20 of the arm 30 is the deflector 34, it comes in contact with the move 6. This connection deflects the lock 4 to an unlocked position. On the opposite side of the arm 30 in this configuration are the spring 24 and the pin 36. The spring's relevance is to assist in the assembly or manufacturing of the knife 50. By pushing the arm 30 downward in the recess 11, and sliding the rotation 32 over the pin 36, the pin 36 snaps back into the helix screw 38. Once the pin 36 is in place, it springs back to its original form by the spring 24. The spring 24 serves no more purpose once the pin 36 is set. (The spring 24 is a convenience for assembly in manufacturing and can be designed out by redesigning the knife 50.)

The third part of the arm 30 is the pin 36. The pin 36 is moved by the rotation 32. As the rotation 32 moves the pin 36, the pin 36 moves the arm 30 and the arm 30 moves forward or reverse. The rotation 32 has three defining properties, the helix screw 38, the snap indicator 40 and the switch indicator 42. All three properties are can be formed as one part.

Inside the rotation 32 is the helix screw 38. This is a negative somewhat curved cavity or slot 52 in the rotation 32 that the pin 36 snaps into at installation. The helix screw 38 is just that, an effective screw, though there is no actual screw in the sense of something sticking out with threads, but it is this screw that drives the arm 30 forward and reverse to a set position to lock and unlock the lock 4. The rotation 32 does not move forward or reverse. It only rotates ¼ of 1 full rotation 32 to drive the arm 30 to lock and unlock. However, the length of turn of rotation is relative to the design of the knife.

On the rotation 32, there is the snap indicator 40. The snap indicator 40 signals to the user by a slight sound or feel that the lock 4 is locked or unlocked. Lastly, there is the switch indicator 42. The switch indicator 42 is an indention on the rotation 32. This mark lines up with two other indention's adjacent on the body 1. The adjacent marks on the body 1 do not move. However, the mark on the rotation 32 does. As the user turns the rotation 32 ¼ turn back and forth the indention's line up to show that the lock 4 is in a locked or unlocked position. Like a pen, the blade 22 side of this knife 50 offers a safety cap 46 that safely stores the knife 50 when not in use. Moreover, the safety cap 46 can be affixed to the opposite end of the knife 50 like a pen. This serves two functions, one to keep the cap 46 from being lost and two, stop the knife 50 from rolling off angle surfaces. Lastly, this knife 50 has a place to store extra blades 22 on the back side of the body 1.

Figures 2A, 2B, 2C, 2D:
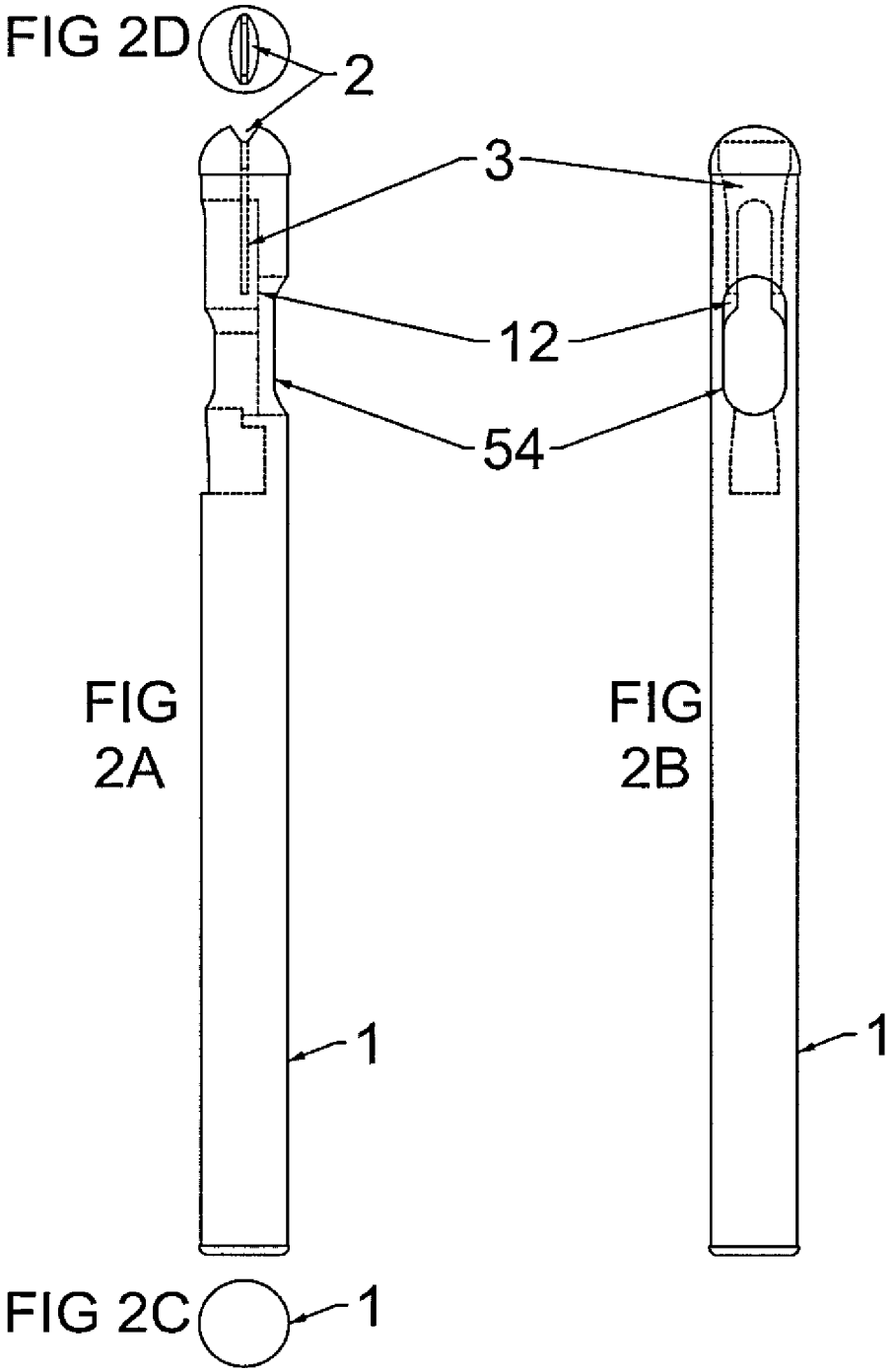
Figures 2H, 2I, 2J, 2K:
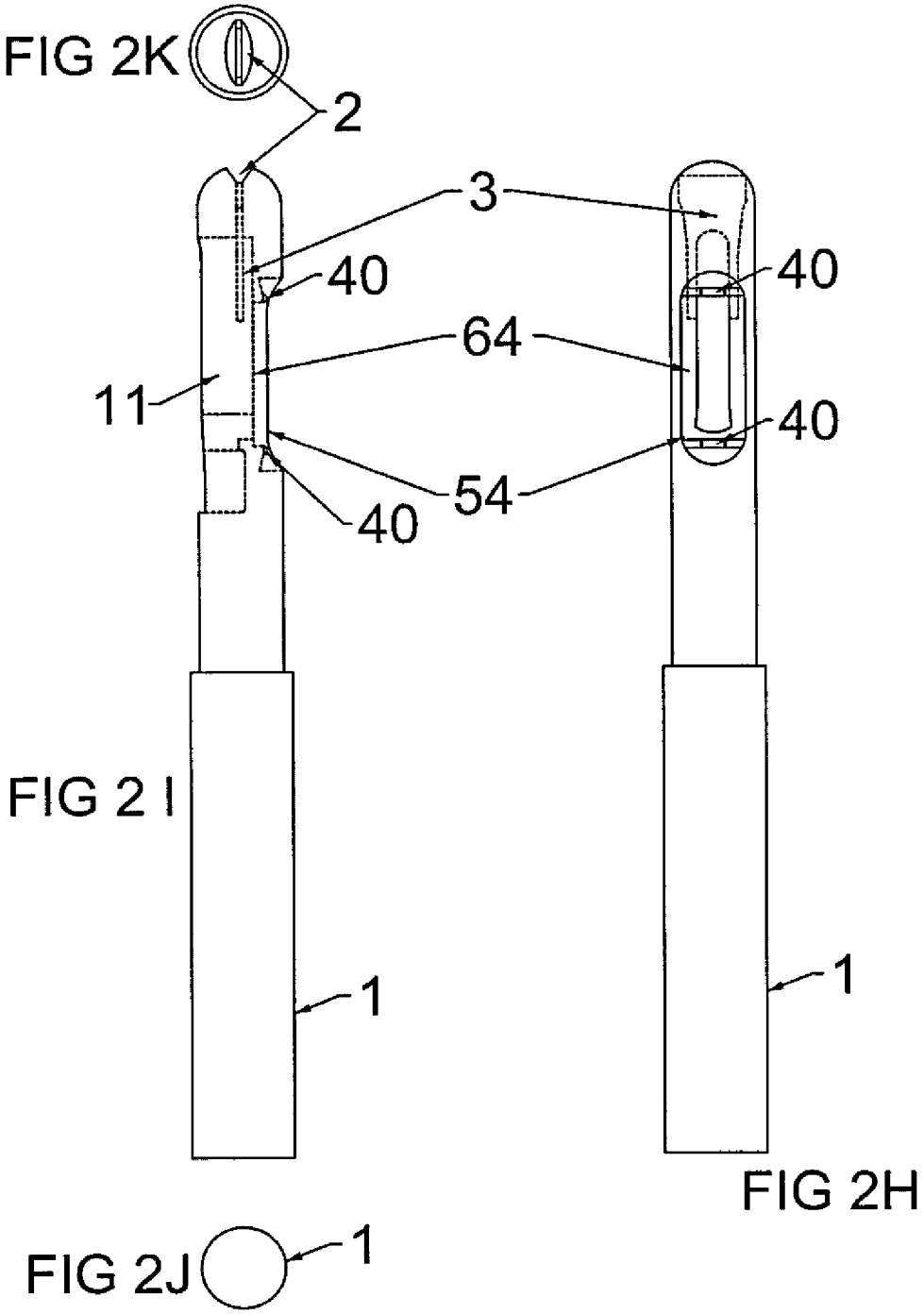
FIGS. 2H-2P show a third embodiment of the present invention.
Figures 2L, 2M, 2N:
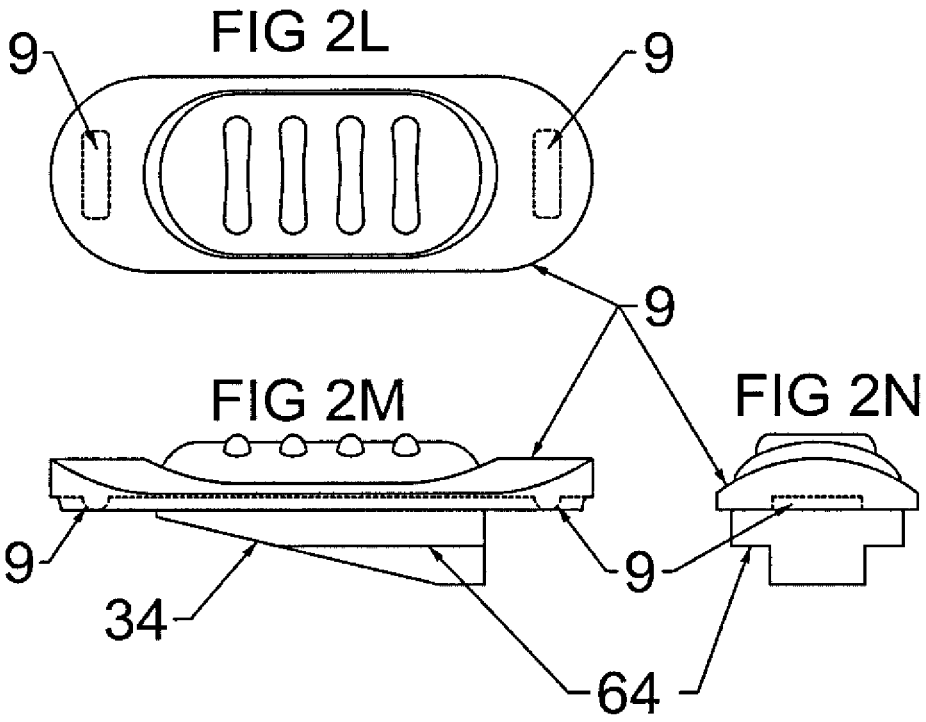
Figure 2O:
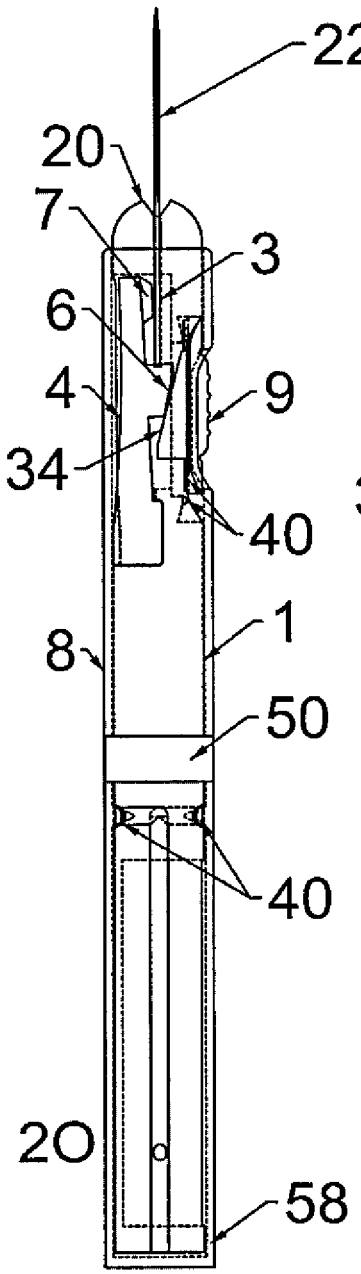
Figure 2P:
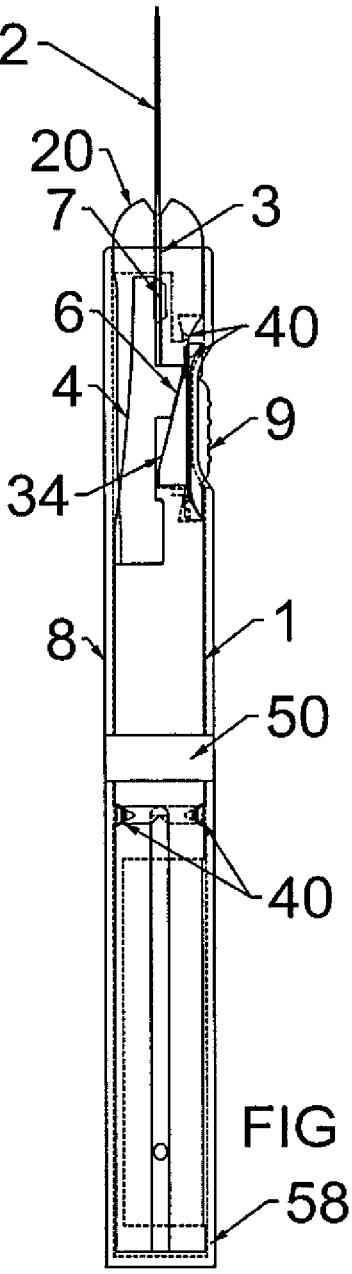

In another embodiment, as shown in FIGS. 2A-2P, on the front end 20 of the body 1, is the mouth 2. This is where the craft blade 22 is guided into the craft knife 50 to assist for faster installation. Through the mouth 2 is the rest zone 3. This is where the blade 22 comes to a set position. Around the rest zone 3 resides the lock 4. The lock 4 is what moves the lock end 7. The lock end 7, when moved, penetrates the rest zone 3 to contact and hold tight the blade 22 end. Also, the lock end 7 has a shape or protrusion and the shape can be hard or made of multiple materials that are hard and rubbery. The shape of hard or hard and rubbery materials, fits or fills into the hole 26 at the bottom 28 of the blade 22 to hold it tight. For instance, the lock 4 may be all hard plastic, or the lock end 7 is a rubber nib or metal tip glued to the stem 48 of the lock 4.

The lock 4 in this configuration is moved to lock or unlock by a switch 9. In a first version of this embodiment, the switch 9 is a thumb button, as shown in FIGS. 2A-2G. By pressing down on or squeezing the thumb button, the force compresses the move 6, causing the lock end 7 to move between the locked state and the unlocked state.

In a second version of this embodiment, as shown in FIGS. 2H-2P, the switch 9 fits into and moves in a slot 52 about an opening 54 in the body 1 that communicates with the recess 11. The underside of the switch 9 has a deflector 34 that engages with the move 6 when the switch 9 is moved in the slot 52, to cause the lock end 7 to move between a locked an unlocked state. The top side of the switch 9 may have grooves against which a finger or thumb can push to facilitate movement of the switch 9 in the slot 52.

In yet another embodiment, as shown in FIGS. 3A-3C, within the rest zone 3 is a lining of hard or rubbery material that is glued or fastened or 3*d* printed to the inside surface of the rest zone 3. There is a jaw 56 of the body 1 having the rest zone 3 and the lock end 7 extending up from the rest zone 3. The jaw 56 is in a separated position when the lock 4 is not in its locked state. There is a housing 8 fitted over the body 1, which when the housing 8 slides forward to its locked position, squeezes the jaw 56 together with the reminder of the body 1, squeezing the lock end 7 into the hole 26 in the bottom 28 of the blade 22, putting the blade 22 and body 1 in a locked state. However, the craft knife 50 with the lock 4 and switch 9 can use the jaw 56 also by fitting the lock end 7 on the fixed part of the body 1.

In still another embodiment, as shown in FIGS. 4A-4C, the housing 8 is disposed about the body 1. The housing 8 acts as the switch 9 as it moves forward and back, to engage with the move 6 to move the lock end 7 between the locked state and the unlocked state with the blade 22. At the rear end 58 of the body 1 can be a pinch lock 68 having a ridge 66 that holds the housing 8 in the forward position in the locked state, and when pinched, the ridge 66 is able to be overridden by the housing 8 as it moves back toward the rear end 58.

In still another embodiment, as shown in FIGS. 6A-6D, on this craft knife 50 are two openings, the mouth 2 opening, and the move 6 opening, the mouth 2 opening is located at the front end 20 of the craft knife 50 and the move 6 opening is located on the body 1 surface so on one end of the body 1, is the mouth 2 opening. This is where the craft blade 22 is guided into the craft knife 50 to assist for faster installation. Through the mouth 2 opening is the rest 3, this is where the craft blade 22 comes to a set position. Around the rest 3 resides the lock 4. The lock 4 has three defining properties. The base 5, the move 6, and the lock end 7. (All three properties can be formed as one part.) The base 5 is the part of the lock 4 that is attached to the body 1. That means it is free on all sides but the fixed side. This allows it to work like a diving board or to be springy. Between the lock end 7 and the base 5 is the move 6. The move 6 is the part of the lock 4 that extends flush with the bodies surface through the move opening. Since the move is connected to the lock 4 and the move is exposed by the move opening, the lock 4 can be adjusted to lock and unlock by a compressed force. So when you compress the move with your thumb it unlocks the lock 4 and when you decompress the move it releases the lock 4 to spring back in its natural state. In order to replace a blade 22, the move needs to be in the compressed state or else it reverts back to its locked position. On the free side of the lock 4 is the lock end 7. The lock end 7 is the part of the lock 4 that penetrates the rest 3 and comes in contact with the craft blade 22 base opening configuration. The lock end 7 has an elongate portion 99 which extends freely from the base and a shape 101 which projects perpendicularly from the elongate portion 99 and the shape 101 can be hard or made of multiple materials that are hard and rubbery. The shape 101 of hard or hard and rubbery materials fits, fills or squeezes into the craft blade 22 end configuration to hold it tight. This knife 50 type can have a housing 8 with an opening 54 on the surface for the move. The purpose of the housing 8 is to strengthen the body 1 so that the knife 50 is strong enough to handle the pressure of the user. However, it is not necessary to have a housing 8 if the material of the body 1 is strong enough to handle the pressure of the user. Like a pen, the blade 22 side of this craft knife 50 offers a safety cap 46 that safely stores the knife 50 when not in use. Moreover, the safety cap 46 can be affixed to the opposite end of the craft knife 50 like a pen. This serves two functions, one to keep the cap 46 from being lost and two, stop the craft knife 50 from rolling off-angle surfaces. Lastly, this craft knife 50 has a place to store extra blades 22 on the back side of the craft blade.

In still another embodiment, as shown in FIGS. 7A-7D, on this craft knife 50 is two openings, the mouth 2 opening, and the thumb lock opening, the mouth 2 opening is located at the front end 20 of the craft knife 50 and the thumb lock opening is located on the body 1 surface. So on one end of the body 1, is the mouth 2. This is where the craft blade is guided into the craft knife 50 to assist for faster installation. Through the mouth 2 is the rest 3, this is where the craft blade comes to a set position. Around the rest 3 resides the lock 4. The lock 4 has four defining properties. The base 5, the move 6, the thumb lock and the lock end 7. (All properties but the thumb lock can be formed as one part.) The base 5 is the part of the lock 4 that is attached to the body. That means it is free on all sides but the fixed side. This allows it to work like a diving board or to be springy. Between the lock end 7 and the base 5 is the move 6. The move 6 is the part of the lock 4 that extends to the thumb lock and the thumb lock is flush to the body's surface through the thumb lock opening. Since the move 6 is connected to the lock 4 and thumb lock and the thumb lock is exposed by the thumb lock opening, the lock 4 can be adjusted to lock and unlock by a compressed force. So when you compress the thumb lock with your thumb, it moves the move to unlock the lock 4 and when you decompress the thumb lock it releases the lock 4 to spring back in its natural state. In order to replace a blade 22, the thumb lock needs to be in the compressed state or else it reverts back to its locked position. Moreover, the thumb lock can slide forward and reverse. In its reverse state, it is able to compress to lock and unlock. However in its forward state, the thumb lock slides over a ledge that is part of the body 1, this doesn't allow it to compress. More still, at the end of the forward and reverse motion are snap indicators to lock the thumb lock so it does not slide off the ledge. On the free side of the lock 4 is the lock end 7. The lock end 7 is the part of the lock that penetrates the rest 3 and comes in contact with the craft blade 22 base opening configuration. The lock end 7 has a shape and the shape can be hard or made of multiple materials that are hard and rubbery. The shape of hard or hard and rubbery materials fits, fills or squeezes into the craft blade 22 end configuration to hold it tight. This knife 50 type can have a housing 8 with an opening 54 on the surface for the move. The purpose of the housing 8 is to strengthen the body 1 so that the knife 50 is strong enough to handle the pressure of the user. However, it is not necessary to have a housing 8 if the material of the body 1 is strong enough to handle the pressure of the user. Like a pen, the blade 22 side of this craft knife 50 offers a safety cap 46 that safely stores the knife 50 when not in use. Moreover, the safety cap 46 can be affixed to the opposite end of the craft knife 50 like a pen. This serves two functions, one to keep the cap 46 from being lost and two, stop the craft knife 50 from rolling off-angle surfaces. Lastly, this craft knife 50 has a place to store extra blades on the back side of the craft blade 22.

In still another embodiment, as shown in FIGS. 8A-8E, on this craft knife 50 is two openings, the mouth opening and the thumb switch opening, the mouth 2 opening is located at the front end 20 of the craft knife 50 and the thumb switch opening is located on the body 1 surface. So on one end of the body 1, is the mouth 2. This is where the craft blade 22 is guided into the craft knife 50 to assist for faster installation. Through the mouth is the rest 3, this is where the craft blade 22 comes to a set position. Around the rest 3 resides the lock 4. The lock 4 has three defining properties. The base 5, the move 6, and the lock end 7. All three properties are formed as one part. (However, the lock end can be made of other materials.) The base 5 is the part of the lock that is attached to the body 1. That means it is free on all sides but the fixed side. This allows it to work like a diving board or to be springy. Between the lock end 7 and the base 5 is the move 6. The move 6 is the part of the lock that comes in contact with the thumb switch. When the switch 9 proceeds forward and contacts the move 6, the lock 4 spring force is deflected to relocate the lock end 7 out of the way for the craft blade 22 to be placed into or out of the rest. When the thumb switch is drawn back away from the move 6, the spring force returns the lock 4 to its original position. It is in the release position that the lock end 7 penetrates the rest to contact the craft blade end opening. (However, it could be reversed.) On the free side of the lock 4 is the lock end 7. The lock end 7 is the part of the lock that penetrates the rest 3 and comes in contact with the craft blade base opening configuration. The lock end 7 has a shape and the shape can be hard or made of multiple materials that are hard and rubbery. The shape of hard or hard and rubbery materials fits, fills or squeezes into the craft blade end configuration to hold it tight. The lock 4 in this configuration is moved to lock or unlock by a thumb switch. The thumb switch is used to lock and unlock the lock 4 and is made in one part. It has four properties, the grip the deflector 34 the snap indicators and the arm 30. The grip has a textured surface for movement. This allows the user to slide the switch forward and reverse. The deflector 34 comes in contact with the move 6. This connection deflects the lock 4 to a lock and unlocked position. The snap indicators in the forward and reverse position snap and hold the thumb switch in place as it is in the forward or reverse position. However, in place of the snap indicators can be a spring. The spring can be a separate part or built into the arm 30 or body 1. The spring forces the thumb switch to stay in the locked position. So you would have to keep forward pressure on the thumb switch to replace a blade 22. Lastly the arm 30, this allows the thumb switch to be placed towards the back of the body 1 to keep the thumb switch out of the way when in use. This knife 50 type can have a housing 8 with an opening 54 on the surface of the thumb switch. The purpose of the housing 8 is to strengthen the body 1 so that the knife 50 is strong enough to handle the pressure of the user. However, it is not necessary to have a housing 8 if the material of the body 1 is strong enough to handle the pressure of the user. Like a pen, the blade 22 side of this craft knife 50 offers a safety cap 46 that safely stores the knife 50 when not in use. Moreover, the safety cap 46 can be affixed to the opposite end of the craft knife 50 like a pen. This serves two functions, one to keep the cap 46 from being lost and two, stop the craft knife 50 from rolling off-angle surfaces. Lastly, this craft knife 50 has a place to store extra blades on the back side of the craft blade 22.

Referring to FIGS. 9A-9F, there is shown another embodiment of a retractable body that is driven in a housing. This craft knife setup has 4 parts to it, the body 1, lock 4, housing 8 and rotation switch. The body 1 has 5 properties, the mouth 2, rest 3, lock 4, female screw cavity, and the alignment buds. On one end of the body, is the mouth. This is where the craft blade is guided into the craft knife to assist for faster installation. Through the mouth is the rest, this is where the craft blade comes to a set position. Around the rest resides the lock. The lock has three defining properties. The fixed end, the move, and the lock end. All three properties are formed as one part. (However, the lock end can be made of other materials.) The fixed end is the part of the lock that is attached to the body. That means it is free on all sides but the fixed side. This allows it to work like a diving board or to be springy. The move is the part of the lock that comes in contact with the housing, this causes the lock to lock and unlock. The body is driven in and out of the housing so when the bodies head is out of the housing the lock is in the unlock position. However, when the body is driven in the housing by the rotation switch, the lock is moved to penetrate the rest to lock the craft blade configuration. On the free side of the lock is the lock end. The lock end is the part of the lock that penetrates the rest and comes in contact with the craft blade base opening configuration. The lock end has a shape and the shape can be hard or made of multiple materials that are hard and rubbery. The shape of hard or hard and rubbery materials fits, fills or squeezes into the craft blade end configuration to hold it tight. Lastly is the alignment buds. The alignment buds are located at the back side of the body on opposite sides of each other. The purpose of the alignment buds is to keep the body in a fixed position so it will not twist as you turn the rotation switch. These buds slide back and forth along path indentions. These path indentions travel the distance of the knives 3 positions. The housings purpose is to hold all parts of this craft knife, meaning body, rotation switch and part of the rotation switch lock. Also, it deflects the move to lock and unlock. The rotation switch lock can be part of the housing, part of the rotation switch or both. In this configuration, it is both. The purpose of the rotation switch lock is to lock the body in 3 positions, retracted, extend cut, and extend release. Retracted is when the blade is hidden within the housing. Extend cut is when the knife is in use. Extend release is when the blade can be replaced. The rotation switch has 3 properties, the knob 13, screw, and part of the rotation switch lock. The knob 13 turns the screw that moves the body forward and reverse. The knob 13 also has within it the rotation switch lock. How the rotation switch lock works. Grab and pull the knob 13 away from the housing, this unlocks the knob 13 and allows the knob 13 to rotate back and forth in 3 positions, which is the Retracted, extend cut and extend release. To each of those positions are snap indicators. As you rotate the knob 13 the snap indicators have a slight sound and feel when they snap into position. Switch indicators on the housing and rotation switch coincide with the snap indicators to visually see the set positions. Attached to the knob 13 is the screw. The screw drives the body forward and reverse for the 3 positions. Once the position is set, the user pushes the knob 13 back into or towards the housing to lock the rotation switch from turning. This keeps it safely locked in its retracted state preventing the knife blade to become unsafe. Also in keeps it locked so the blade does not move in the cutting state. Lastly, it stops the body from moving when in the release state or replacing the blade.

The illustrated embodiments are configured to utilize a standard X-ACTO™ blade X11.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A knife for holding a blade having a bottom with a hole and a cutting tip which extends from the bottom, the knife comprising:

a body having a rest zone for the bottom of the blade disposed in the body, a mouth at a front end of the body which receives the bottom of the blade, the mouth guiding the bottom of the blade to the rest zone, and a recess in communication with the rest zone and a mover opening located on the body surface, the body having a rear end and a side between the front end and the rear end; and a lock disposed in the recess for securely holding the blade, the lock having a base which is fixedly attached inside the body to the side and a lock end having an elongate portion and a shape which extends perpendicularly from the elongate portion, when in a locked state, the shape of the lock end is disposed in the hole in the bottom of the blade and holds the blade in place so that the blade is unable to move from the rest zone, when in an unlocked state, the lock end separates from and is apart from the hole in the bottom of the blade so the blade can be moved from the rest zone, the lock having a mover disposed between the lock end and the base, when a compressive force is applied to the mover, the mover moves the lock end down into the unlocked state from the locked state, when the compressive force is removed, the lock end reverts back to the locked state, the base and the lock end and the mover of the lock being one continuous piece, the mover positioned in the mover opening so the compressive force can be applied to the mover through the body, the mover flush with the body surface when the lock end is in the locked state, the elongate portion and the shape of the lock end disposed inside the body when the lock end is in the unlocked state, the mover extends above the lock end, the elongate portion of the lock end extending from the base and free to move.

2. A method for using a knife comprising the steps of:

inserting a bottom end of a blade through a mouth at a front end of a body until the bottom of the blade is disposed on a rest zone in the body, the mouth guiding the bottom of the blade to the rest zone; and applying a compressive force to a mover of a lock disposed in a recess of the body in communication with the rest zone so the mover moves a lock end of the lock to an unlocked state from a locked state, the lock for securely holding the blade, the lock having a base which is fixedly attached inside the body to a side of the body between a front end and a rear end of the body, when in the locked state, the lock end is disposed in a hole in the bottom of the blade and holds the blade in place so that the blade is unable to move from the rest zone, when in the unlocked state, the lock end separates from and is apart from the hole in the bottom of the blade so the blade can be moved from the rest zone, the mover disposed between the lock end and the base, when the compressive force is removed, the lock end reverts back to the locked state, the base and the lock end and the move of the lock being one continuous piece, the mover positioned in the mover opening so the compressive force can be applied to the mover through the body, the mover flush with the body surface when the lock end is in the locked state, the elongate portion and the shape of the lock end disposed inside the body when the lock end is in the unlocked state, the mover extends above the lock end, the elongate portion of the lock end extending from the base and free to move.

* * * * *